US005380059A

United States Patent [19]

Felling

[11] Patent Number: 5,380,059

[45] Date of Patent: Jan. 10, 1995

[54] KNOCK-DOWN SHELTERING LOUNGE WITH CENTER PIVOT

[76] Inventor: Gerald J. Felling, 230 Arroyo Rd., Lagunitas, Calif. 94938

[21] Appl. No.: 896,052

[22] Filed: Jun. 9, 1992

[51] Int. Cl.[6] ..... A47C 7/62

[52] U.S. Cl. ..... 297/184.15; 797/344.23; 797/473.21; 5/656; 135/96; 180/22; 280/79.2

[58] Field of Search ..... 297/184.1, 184.15, 184.14, 297/344.23, 423.21, 423.19; 5/656; 135/96, 97, 103, 106, 117, 119; 180/22; 280/79.2

[56] References Cited

U.S. PATENT DOCUMENTS

| | | | |
|---|---|---|---|
| 1,538,064 | 5/1925 | Skog | 135/97 |
| 2,132,467 | 10/1938 | Hanson | 297/344.21 |
| 2,281,085 | 4/1942 | Bell | 297/423.21 |
| 2,337,975 | 12/1943 | Dane | 297/184.15 |
| 2,596,760 | 5/1952 | Bryant | 297/354.13 |
| 3,083,055 | 3/1963 | Davis | 297/362.11 |
| 3,425,709 | 2/1969 | Fields | 280/79.2 |
| 4,004,836 | 1/1977 | Kristensson | 297/354.13 |
| 4,575,113 | 3/1986 | Bourdreau | 280/79.2 |
| 4,597,119 | 7/1986 | Padgett | 5/656 |
| 5,046,782 | 9/1991 | Lundeen | 5/656 |

FOREIGN PATENT DOCUMENTS

| | | | |
|---|---|---|---|
| 42833 | 6/1910 | Austria | 297/184.14 |
| 738119 | 8/1943 | Germany | 297/184.1 |
| 908666 | 4/1954 | Germany | 297/184.1 |
| 901945 | 6/1954 | Germany | 297/184.14 |
| 7323 | of 1895 | United Kingdom | 135/97 |
| 2052960 | 2/1981 | United Kingdom | 297/184.15 |

*Primary Examiner*—Flemming Saether

*Attorney, Agent, or Firm*—Majestic, Parsons, Siebert & Hsue

[57] ABSTRACT

An adjustable lounge is adapted to be knocked-down in kit-form for shipping and/or storage purposes and expeditiously assembled on-site. The knocked-down lounge comprises a base frame having a sub-frame and a pair of base side panels adapted for attachment to lateral sides of the sub-frame. A canopy frame comprises a pair of canopy side panels and a plurality of cross-struts adapted for attachment between the canopy side panels. The canopy frame is adapted to be pivotally mounted on the base frame to permit the canopy frame to be moved by user-controlled actuating means through an infinite number of positions between a normal upright position and a lowered position, placing the back of the canopy frame in at least general horizontal alignment with the top of the base frame. The lounge is adapted for selective rotation in a circular path about a vertically disposed axis whereby the frontal side of the canopy can be moved to a selected rotative position for sunning and/or viewing purposes.

23 Claims, 5 Drawing Sheets

KNOCK-DOWN SHELTERING LOUNGE WITH CENTER PIVOT

TECHNICAL FIELD

This invention relates generally to a recreational seating and lounging arrangement and more particularly to a pivotal sheltering lounge adapted to be knocked-down for shipping and storage purposes.

BACKGROUND OF THE INVENTION

My U.S. Pat. Nos. 5,015,032, 5,069,504 and 5,092,653 describe recreational lounges that have found widespread use, particularly at beaches and on the sun decks and patios of homes and hotels. Prior to the advent of my lounge, the backrests for conventional chaise lounges, popular in Europe, were normally fixed in position. Thus, the user was unable to adjust the backrest for comfort purposes. Although certain types of these lounges were later modified to permit the backrest to pivot and incline on a base, the externally operated locking mechanisms therefor proved difficult to manipulate and the substantial weight of the backrest (e.g., 75 lbs.) rendered the lounges impracticable for everyday use.

My above-referenced patents disclose lounges that overcome the above, briefly discussed problems of the prior art. In particular, each lounge comprises an adjustable canopy pivotally mounted on a frame to adjust the inclination of the canopy between an upright position and a lowered position, and operator-control means for selectively pivoting the canopy. The lounges have exhibited excellent performance, but have proven somewhat bulky for storage and/or shipping purposes. Further, I have discovered that it is desirable to provide the lounge chairs with the capability of being easily rotated for selective sunning and/or viewing purposes. The lounge of this invention solves the latter problems.

SUMMARY OF THE INVENTION

An object of this invention is to provide an adjustable lounge of the general type disclosed in my above-referenced patents, but which can be knocked-down in kit-form for shipping and/or storage purposes and expeditiously assembled on-site.

A further object is to provide the lounge with the capability of being rotated to a selected position, either manually or automatically, by the user.

The knocked-down lounge of this invention comprises a base frame having a sub-frame and a pair of base side panels adapted for attachment to lateral sides of the sub-frame. The lounge further comprises a pair of canopy side panels and a plurality of cross-struts adapted for attachment between the canopy side panels to form a canopy frame. The canopy frame is adapted to be pivotally mounted on the base frame to permit the canopy frame to be moved by user-controlled actuating means through an infinite number of positions between a normal upright position and a lowered position, placing the back of the canopy frame in at least general horizontal alignment with the top of the base frame.

In another aspect of this invention, pivot means, mounted beneath the base frame and positioned at least approximately centrally thereof, adapts the lounge for selective rotation in a circular path about a vertically disposed axis whereby the open frontal side of the canopy can be moved to a selected rotative position for sunning and/or viewing purposes.

BRIEF DESCRIPTION OF THE DRAWINGS

Other objects and advantages of this invention will become apparent from the following description and accompanying drawings wherein.

DESCRIPTION OF THE PREFERRED EMBODIMENTS

Figure 1:
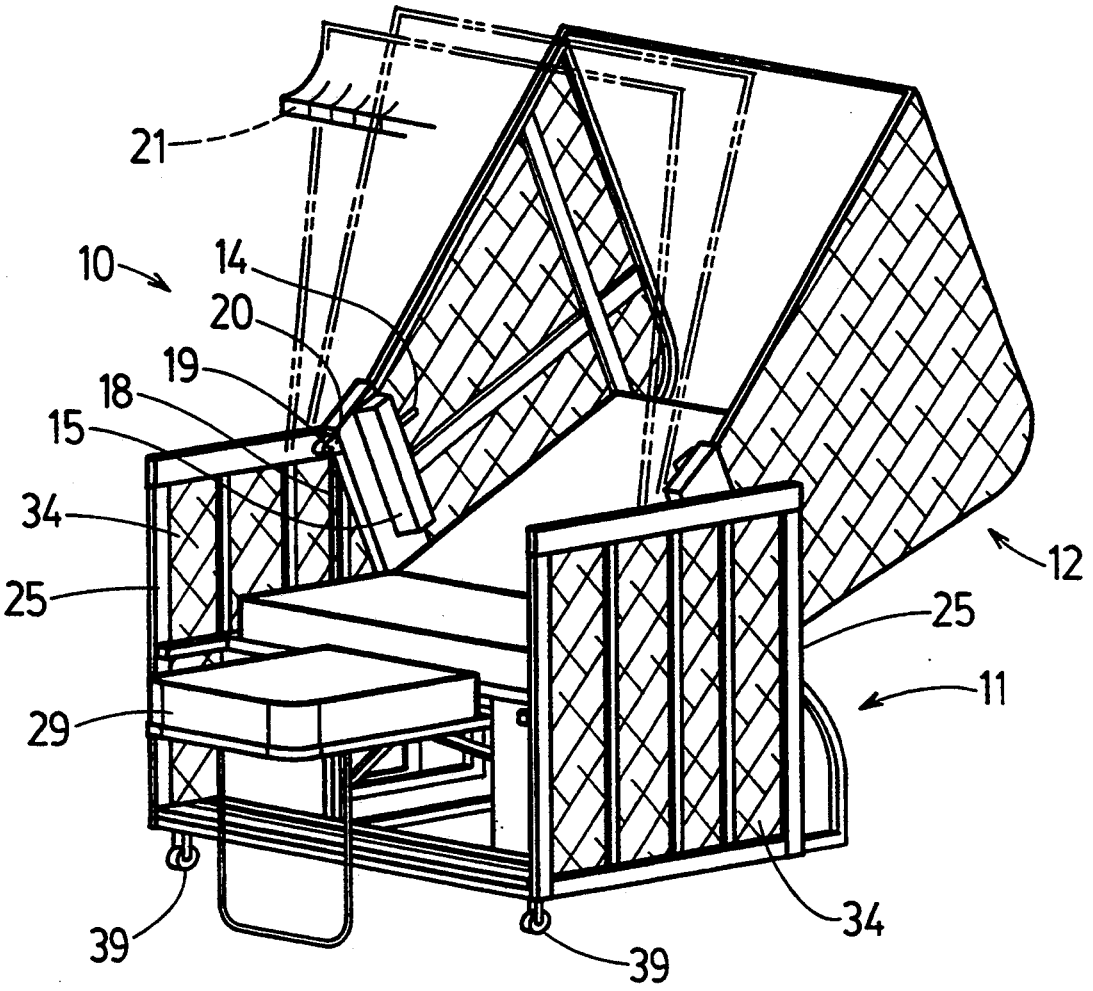
FIG. 1 is a frontal perspective view schematically illustrating a lounge embodying this invention with a canopy thereof shown in a lowered position and further showing various raised positions of the canopy in phantom lines.
Figure 2:
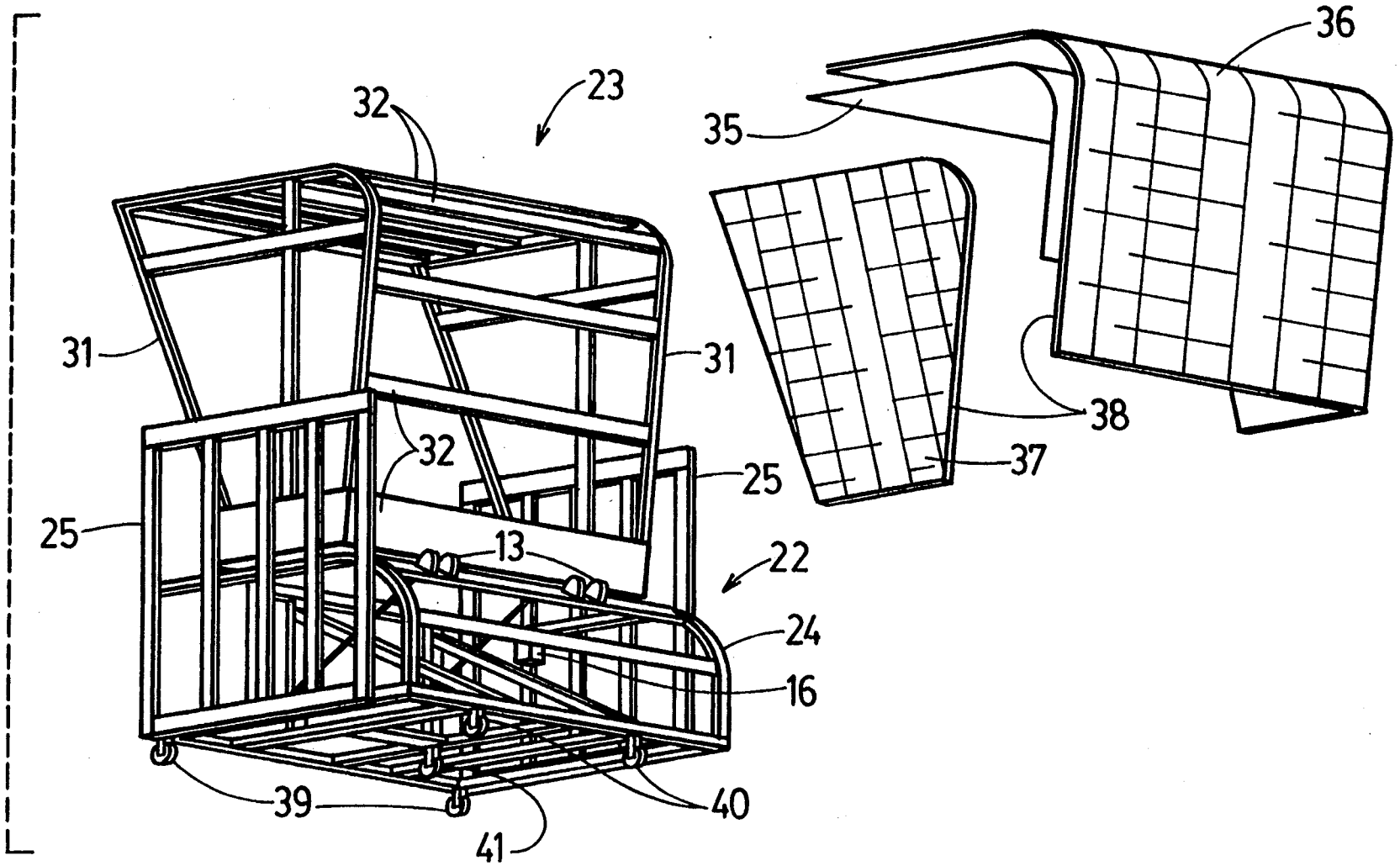
FIG. 2 is an exploded perspective view illustrating the mounting of a canopy frame on a base frame and cover panels adapted to be attached to the canopy frame.
Figure 3:
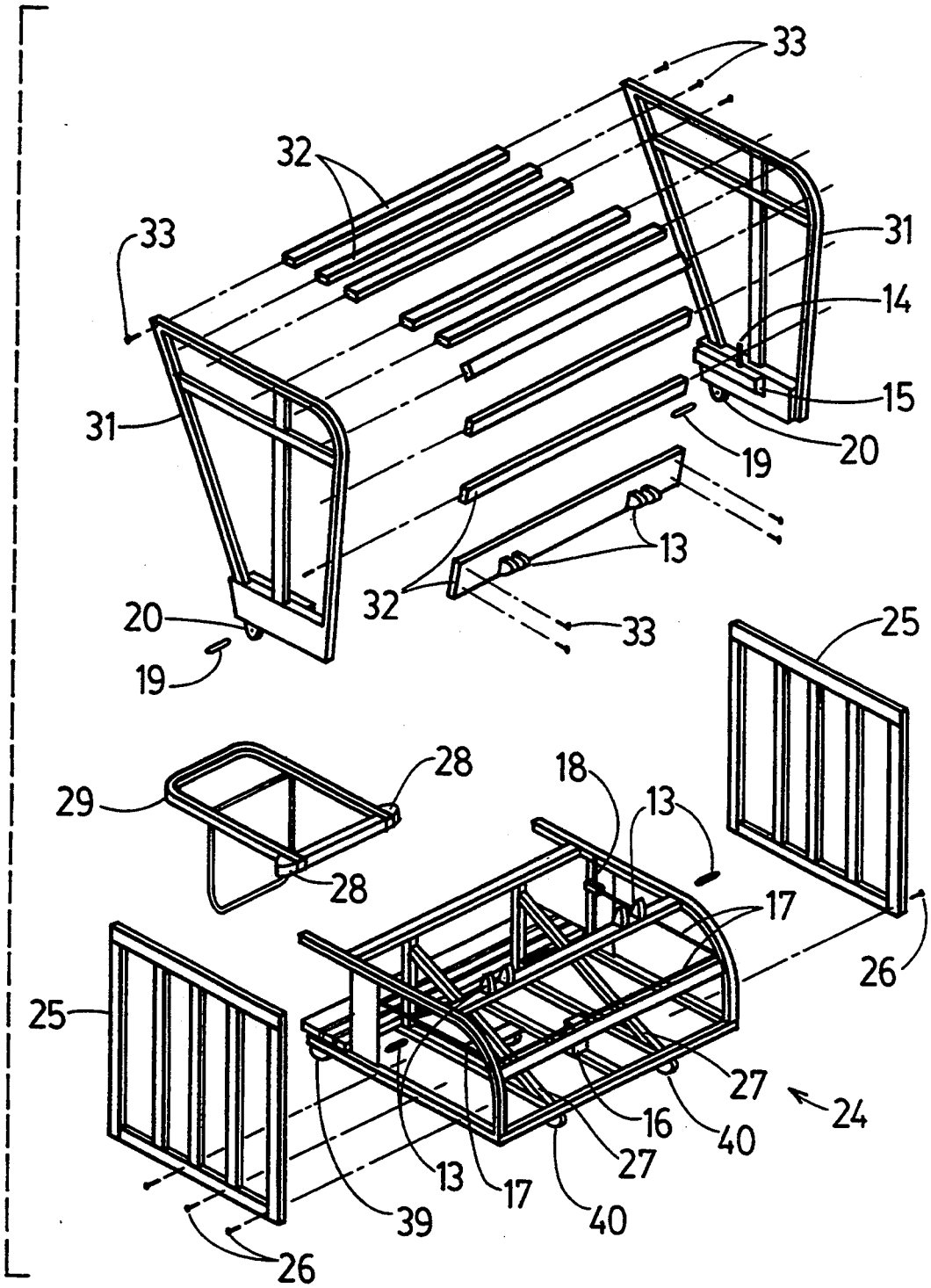
FIG. 3 is an exploded view of the canopy and base frames, illustrating component parts thereof that can be packaged in kit-form for shipping and/or storage purposes.

FIG. 1 illustrates a lounge 10 comprising a base 11 having a canopy 12 pivotally mounted rearwardly thereon by laterally spaced and aligned bracket and pivot assemblies 13 (FIGS. 2 and 3). The canopy is adapted to be selectively pivoted, under control of the user, from a normal upright position forming a seating arrangement to its illustrated lowered position, forming a bed-like or "sunning" arrangement. As fully described in applicant's above-referenced U.S. Pat. No. 5,069,504, the disclosure of which is incorporated by reference herein, a three-way (up, down and neutral positions) switch 14 is mounted on an armrest 15, secured within canopy 12, to permit the user to selectively move the canopy to a chosen pivoted position on base 11.

As schematically illustrated in FIGS. 1–3, the switch is adapted to activate a combined moving, holding and locking control system mounted in base 11. The control system comprises an electric battery-driven (e.g., eight volt battery) reversible motor 16 secured on the base, drive cables 17 and a pair of threaded drive rods 18 (one shown in FIG. 3) suitably mounted on opposite sides of base 11. As described in U.S. Pat. No. 5,069,504, the upper end of each drive rod is adapted to be pivotally connected by a pin 19 to a bracket 20 (FIG. 3), secured to canopy 12. Thus, selective extension or retraction of the drive rod will function to pivot the canopy about the co-incident axes of pivot assemblies 13 on the base. Since applicant's referenced patents fully describe the combined moving, holding and locking control system in detail, further explanation thereon is deemed unnecessary for a full understanding of this invention. The patents also describe the optional use of a retractable sun shade 21, mounted on canopy 12 as schematically shown in FIG. 1.

Referring to FIG. 3, one aspect of this invention is the ability to fabricate and knock-down lounge 10 to package it in kit-form for subsequent assembly on-site. As shown in FIGS. 2 and 3, base 11 comprises a base frame 22 whereas canopy 12 comprises a canopy frame 23 adapted to be assembled and pivotally mounted on the base frame by laterally spaced bracket and pivot pin assemblies 13. As shown in FIG. 3, the base frame comprises a base sub-frame 24 having lateral sides and a horizontally disposed top adapted to retain a seating cushion thereon (FIG. 1).

Base frame 22 further comprises a pair of base side panels 25 each adapted for attachment to a respective lateral side of the base sub-frame by fastening means, such as screws 26. The base frame has a pair of inclined and laterally spaced slotted rails 27 secured therein to receive rollers 28, secured on the end of a footrest frame 29, whereby the footrest frame is adapted to slide into the base frame for storage purposes therein. As further shown in FIGS. 2 and 3, canopy frame 23 comprises a pair of canopy side panel frames 31 and a plurality of cross-struts 32, adapted to have opposite ends thereof suitably attached to the canopy side panel frames by fastening means, such as screws 33, to form the canopy frame.

For shipping purposes, the component parts of the lounge, illustrated in FIG. 3, can be compactly packaged in and about base sub-frame 24 to reduce the volume of the lounge to approximately one-fourth of its erected size shown in FIG. 1. When the knocked-down lounge arrives at its destination, the component parts can then be unpackaged for expeditious assembly. As shown in FIG. 1, base side panels 25 preferably have upholstery 34 secured thereon, prior to shipment.

However, since canopy 12 must be broken-down for shipping purposes, FIG. 2 illustrates upholstery that is applied to canopy frame 23 on-site. In particular, the upholstery may comprise a liner 35 that is first stapled or otherwise suitably secured on the top and back of the canopy frame. The liner is then covered with an upholstery main body 36 that covers the top, back and one side panel frame of the canopy frame. After main body 36 has been stapled or otherwise suitably secured to frame 23, a separate upholstery side panel 37 is releasably attached by a zipper 38 (or Velcro type hook and loop fastening means) to side edges of the top and back panels of the upholstery main body to cover the second canopy side panel frame.

The upholstery may comprise any suitable and preferably "breathable" material, such as a natural or synthetic woven fabric that is sufficiently porous to provide air ventilation through the canopy for convenience of the user. Applicant's above-referenced patents disclose alternative materials for the upholstery or covering used for the base and canopy. The component parts composing the base frame and canopy frame may be wood or structural plastic, steel or aluminum tubing or a combination thereof, as also described in the above-referenced patents.

As further shown in FIGS. 1–3, base frame 22 is suitably mounted on a pair of laterally spaced front casters 39, a pair laterally spaced rear casters 40 and a center pivot caster 41. The standard casters, when unlocked, facilitate movement of the lounge into various positions at ground level for sunbathing, viewing or other recreational pursuits. Each of the standard casters is an off-the-shelf item, such as the type marketed by The Tente Company under Model No. 2475 or 2470.

Figure 4:
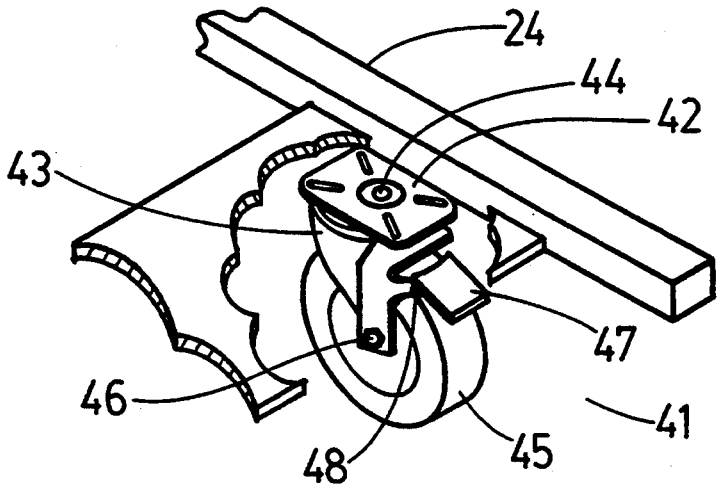
FIG. 4 illustrates a typical pivotal and lockable roller of a caster secured beneath the base frame to provide a center pivot for the lounge.

In particular and as shown in FIG. 4, a typical standard caster of this type comprises a steel mounting plate 42 secured to the underside of base sub-frame 24 and having a bifurcated swivel bracket 43 pivotally mounted thereon by a pivot shaft 34. A synthetic or natural rubber roller 45 is rotatably mounted on the bracket by an axle 46 and a brake lever 47 is pivotally mounted by a pin 48 on the bracket to have an end thereof selectively frictionally engage the roller to lock and prevent rotation thereof when the brake lever is depressed. Lifting of the brake lever will release the roller from its locked condition in a conventional manner. Since casters of this type are well-known in the art, further description thereof is deemed unnecessary for a full understanding of this invention.

Figure 5:
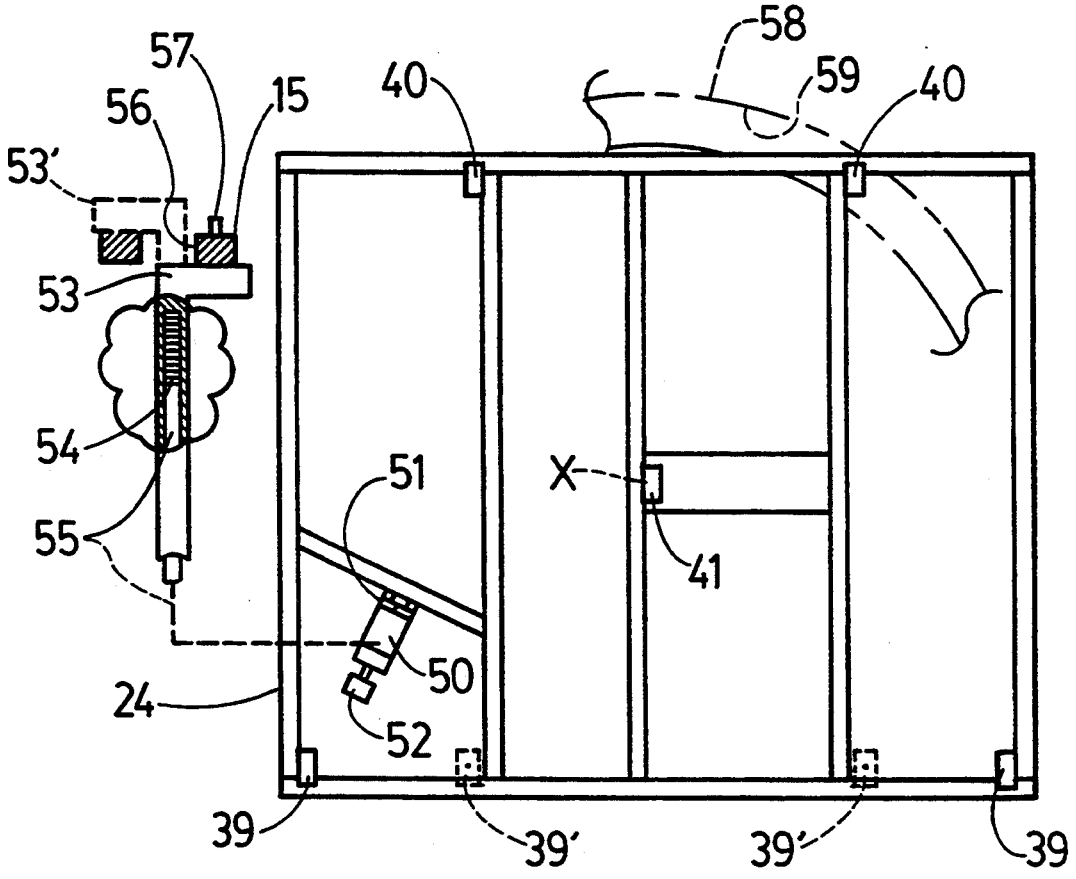
FIG. 5 is a schematic bottom plan view of the base frame, illustrating an operator-controlled drive motor for selectively rotating the lounge and further schematically illustrating a portion of a track in phantom lines, adapted to guide rotative movements of the lounge.

FIG. 5 schematically illustrates the disposition of casters 39–41 on the underside of base sub-frame 24. As shown, front and rear casters 39,40 are concentrically arranged above a vertically disposed pivot axis X (pivot shaft 44 in FIG. 4) of center pivot caster 41. Thus, release of brake levers 46 of only the front and rear casters, with the center pivot caster remaining in its locked or brake-mode of operation, will permit the entire lounge to be rotated about centrally and vertically disposed axis X of pivot shaft 44.

Once the lounge has been rotated to its selected position by the user, brake lever 47 of one or more of the front and rear casters is depressed to lock base sub-frame 24 and thus the lounge in this selected rotative position. This arrangement thus provides pivot means mounted beneath base 11 for selectively permitting the lounge to be rotated in a circular path about vertically disposed axis X (pivot shaft 44 of center pivot caster 41) whereby the open frontal side of canopy 12 can be moved to a selected rotative position for sunning and/or viewing purposes. Release of the brake levers of all of the casters, including caster 41, will permit the lounge to be rolled to another location.

FIG. 5 further illustrates operator-control means for selectively rotating the lounge. An electric drive motor 50 is pivotally mounted on base sub-frame 24 at a hinge connection 51 for vertical movement. The motor is adapted for pivotal movement between a raised and a lowered position whereat a rubber drive wheel 52 will frictionally engage a cement patio or the like for lounge-rotating purposes. In particular and as shown in FIG. 5, when a handle 53 is in its illustrated depressed position under armrest 15, the motor will drop to its lowered position to engage drive wheel 52 whereby activation of the reversible electric drive motor 50 will function to rotate the lounge about vertically disposed pivot axis X of center pivot caster 41. The weight of the motor is sufficient to hold wheel 52 in driving, frictional engagement with the patio.

As further schematically shown in FIG. 5, when handle 53 is retained in its engaged position beneath armrest 15, an optional compression coil spring 54 secured between the handle and a cable 55 will permit the motor to drop. When the handle is turned 90° and returned to its raised, phantom-line position 53' through an accommodating slot 56 formed through armrest 15, cable 55, having its distal end secured to motor 50, will be placed in tension to pivot the motor upwardly about hinge connection 51 to raise drive wheel 52 above ground level. A standard three-position switch 57, suitably connected in a conventional manner between the motor and an electrical six or eight volt battery (not shown) mounted in base sub-frame 24, is secured on armrest 15 for convenience of the user sitting in the lounge.

FIG. 5 further illustrates an alternative lounge-mounting system shown in the form of a foot pad assembly, particularly useful when the lounge is disposed on grass, sand or other soft surface. In particular, the lounge may be rotatably mounted on a schematically and partially illustrated steel ring 58 that has an upwardly facing U-shaped cross-section to define a circular track 59, concentrically disposed relative to vertically disposed pivot axis X of center pivot caster 41. When a circular track of this type is utilized, front casters 39 are preferably repositioned to the illustrated phantom-line positions 39' to be disposed at the same radius from pivot axis X as are rear casters 40, one of which is shown disposed in circular track 59.

It can thus be seen that locking of center pivot caster 41 to fix the position of axis X will permit front casters 39' and rear casters 40 to swivel in the same circumferential path and rotate with the lounge in circular track 59 whereby the lounge can be rotated to a selective sunning position. Such rotative adjustment can be made either manually or under control of drive wheel 52. The drive wheel can also be radially disposed on the same radius as the casters to engage within circular track 59, if so desired.

Figure 6:
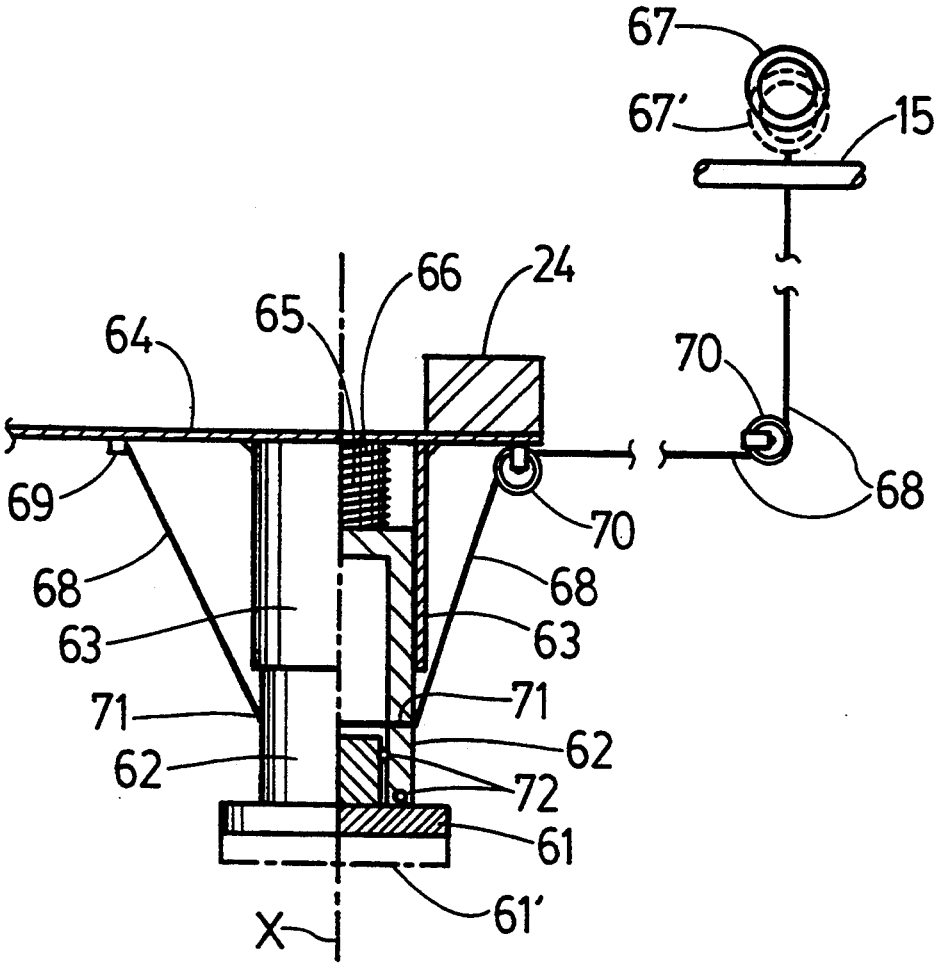
FIG. 6 schematically illustrates an alternative center a pivot and an operator-controlled actuating mechanism therefor.

FIG. 6 discloses an alternate center pivot arrangement that would normally replace center pivot caster 41 (FIG. 5). This alternate pivot means comprises a reciprocally mounted elastomeric foot pad 61 adapted to engage ground level, such as a patio surface, to permit the lounge to be selectively rotated on front and rear casters 39,40 and about a vertically disposed pivot axis X, positioned centrally of the lounge. The foot pad can be suitably rotatably mounted on a distal end of a tubular pad support 62, reciprocally mounted in a guide tube 63. The guide tube has its upper end secured beneath a plate 64 and the plate, in turn, is secured beneath base sub-frame 24 of the lounge.

A compression coil spring 65 is disposed between plate 64 and the upper end of tubular pad support 62 and mounted on a post 66, having its upper end secured beneath plate 64. The spring functions to bias the tubular pad support downwardly to its 61' engaged position. Control means for controlling the raising and lowering of elastomeric foot pad 61 may comprise a finger ring 67 having one end secured to a cable 68 and its opposite end anchored to plate 64 at an anchoring block 69.

Cable 68 is entrained over rollers 70 and extends through openings 71, formed diametrically through tubular pad support 62, whereby reciprocation of finger ring 67 will selectively raise or permit lowering of elastomeric foot pad 61. In particular, when the finger ring is raised to its solid line position illustrated in FIG. 6, cable 68 will function to raise elastomeric foot pad 61 above ground level and against the opposed biasing force of compression coil spring 65 to permit the lounge to be moved.

Conversely, release of finger ring 67 will permit it to move to its 67' phantom line position and release cable 68. Spring 65 will bias foot pad 61 into frictional engagement with a patio or other surface on which the lounge is situated. Standard annular bearings 72 can be suitably mounted between the foot pad and tubular pad support 62 to permit the support and thus the lounge to freely rotate about axis X and relative to the foot pad. The lounge can be locked against rotation by depressing brake lever 47 (FIG. 4) of one or more casters 39 and 40.

A further modification to the above described pivot means contemplates replacing the foot pad assembly shown in FIG. 6 with a single steel rod. The rod could be inserted vertically through a bore (not shown) formed through plate 64 (or frame 24) to have its lower end further engage within a bore drilled in a patio or the like, the lounge could then be selectively rotated about the vertical pivot axis of the rod. It should be noted in FIGS. 1 and 3 that single footrest frame 29 is positioned to provide easy access to the seat by a user and facilitates storage of the foot cushion below rails 27 for storage purposes and to eliminate clutter.

I claim:

1. A knocked-down sheltering lounge in kit-form adapted to be assembled on-site for sunbathing comprising:

a base frame comprising a sub-frame having lateral sides and a horizontally disposed top adapted to retain a seating cushion thereon, said top comprising a plurality of longitudinally spaced and laterally extending cross-struts adapted to be connected and disconnected between the lateral sides of said sub-frame for mounting said seating cushion thereon, and a pair of base side panels adapted to extend vertically above the lateral sides of sub-frame to form arm rests and to confine said seating cushion in said sub-frame, a pair of substantially flat canopy side panel frames and a plurality of individual cross-struts adapted to be spaced one-from-another and have opposite ends thereof attached to said canopy side panel frames to form a canopy frame, open at a frontal side thereof and adapted to be pivotally and removably mounted onto said base frame for permitting said canopy frame to be moved through an infinite number of locking positions between a normal upright position to form a seating arrangement and a fully lowered position placing the back of said canopy frame in at least general horizontal alignment with the top of said base frame to form a bed, one of said cross-struts having pivot means thereon for pivoting said canopy frame on said base frame, and actuating means, adapted to be interconnected between said canopy frame and said base frame, for selectively moving said canopy frame to a selected position between its upright and fully lowered positions, each of said base side panels, said canopy side panel frames and said cross-struts being adapted to be connected to and completely disconnected from each other and being at least substantially flat and sized to be compactly packaged with component parts of said sub-frame to provide a knocked-down sheltering lounge in kit form having a volume that is not more than approximately one-fourth of the erected form of said sheltering lounge for shipping purposes.

2. The sheltering lounge of claim 1 wherein said pivot means includes means for pivotally mounting said canopy frame rearwardly on said base including a pair of laterally spaced bracket and pivot assemblies.

3. The sheltering lounge of claim 1 further comprising operator-controlled combined moving, holding and locking control system means, including said actuating means, mounted in said base frame and adapted to be connected to and disconnected from said canopy frame for selectively moving said canopy frame between its upright and fully lowered positions on said base frame.

4. The sheltering lounge of claim 1 further comprising a pair of inclined and laterally spaced rails secured in said base frame and a footrest frame having rollers thereon adapted to slide on said rails for storage within said base frame.

5. The sheltering lounge of claim 1 further comprising an upholstery main body adapted to cover a top, back and a first one of said canopy side panel frames, a separate upholstery side panel adapted to cover a second one of said canopy side panel frames, and fastening means for releasably attaching said separate upholstery side panel to side edges of the top and back panels of said upholstery main body.

6. The sheltering lounge of claim 5 further comprising a liner adapted for securance to the top and back of said canopy frame.

7. The sheltering lounge of claim 1 further comprising a plurality of spaced casters mounted beneath said sub-frame for permitting said sheltering lounge to be moved to various positions.

8. The sheltering lounge of claim 7 further comprising center pivot means mounted beneath said sub-frame and positioned at least approximately centrally thereof for selectively permitting said lounge to be rotated in a circular path about a vertically disposed axis whereby the frontal side of said canopy frame can be moved to a selected rotative position for sunning and viewing purposes.

9. The sheltering lounge of claim 8 wherein said center pivot means comprises a center pivot caster of said casters.

10. The sheltering lounge of claim 9 wherein said center pivot caster comprises a mounting plate secured to an underside of said sub-frame, a swivel bracket pivotally mounted on said plate for relative pivotal movement about said axis and a roller rotatably mounted on said bracket.

11. The sheltering lounge of claim 10 further comprising brake lever means pivotally mounted on said bracket to selectively prevent rotation of said roller.

12. The sheltering lounge of claim 11 wherein said casters further comprise a pair of laterally spaced front casters and a pair of laterally spaced rear casters and wherein each of said front and rear casters comprise a said mounting plate, swivel bracket, roller, and brake lever means.

13. The sheltering lounge of claim 8 further comprising operator-control means for selectively rotating said lounge about said axis.

14. The sheltering lounge of claim 13 wherein said operator-control means comprises a drive motor, having rotatable drive wheel means movably mounted on said sub-frame and means for selectively moving said drive wheel means from a raised position to a lowered position.

15. The sheltering lounge of claim 8 further comprising track means concentrically disposed relative to said axis for engaging and guiding at least some of said casters in a circular path in response to rotation of said lounge.

16. A sheltering lounge usable for sunbathing comprising a base having laterally spaced and vertically disposed sides and a horizontally disposed top adapted to retain a seating cushion thereon, a normally upright canopy having laterally spaced and vertically disposed sides, a top and a normally upright back all secured together to form a hood open on frontal side, pivot means for pivotally mounting said canopy on said base for permitting said canopy to be moved through an infinite number of positions between a normal upright position to form a seating arrangement and a fully lowered position placing the back of said canopy in at least general horizontal alignment with the top of said base to form a bed, and actuating means for selectively moving said canopy to a selected position between the upright and fully lowered positions, and center pivot means mounted beneath said base and positioned at least approximately centrally thereof for selectively permitting said lounge to be rotated in a circular path about a vertically disposed axis whereby the frontal side of said canopy can be moved to a selected rotative position for sunning and viewing purposes, said base being mounting on a plurality of casters and said pivot means comprising a center pivot caster of said casters.

17. The sheltering lounge of claim 16 wherein said center pivot caster comprises a mounting plate secured to an underside of said base, a swivel bracket pivotally mounted on said plate for relative pivotal movement about said axis and a roller rotatably mounted on said bracket.

18. The sheltering lounge of claim 17 further comprising brake lever means pivotally mounted on said bracket to selectively prevent rotation of said roller.

19. The sheltering lounge of claim 18 wherein said casters further comprise a pair of laterally spaced front casters and a pair of laterally spaced rear casters and wherein each of said front and rear casters comprise a said mounting plate, swivel bracket, roller, and brake lever means.

20. The sheltering lounge of claim 16 further comprising operator-control means for selectively rotating said lounge about said axis.

21. The sheltering lounge of claim 20 wherein said operator-control means comprises a drive motor having a rotatable drive wheel movably mounted on said base and means for selectively moving said drive wheel from a raised position to a lowered position.

22. The sheltering lounge of claim 16 further comprising track means concentrically disposed relative to said axis for engaging and guiding at least some of said casters in a circular path in response to rotation of said lounge.

23. A sheltering lounge usable for sunbathing and the like comprising a base having laterally spaced and vertically disposed sides and a horizontally disposed top adapted to retain a seating cushion thereon, a normally upright canopy having laterally spaced and vertically disposed sides, a top and a normally upright back all secured together to form a hood open on a frontal side, pivot means for pivotally mounting said canopy on said base for permitting said canopy to be moved through an infinite number of positions between a normal upright position to form a seating arrangement and a fully lowered position placing the back of said canopy in at least general horizontal alignment with the top of said base to form a bed, actuating means for selectively moving said canopy to a selected position between the upright and fully lowered positions, center pivot means mounted beneath said base and positioned at least approximately centrally thereof for selectively permitting said lounge to be rotated in a circular path about a vertically disposed axis whereby the frontal side of said canopy can be moved to a selected rotative position for sunning and/or viewing purposes, and operator-control means for selectively rotating said lounge about said axis comprising a drive motor having a rotatable drive wheel movably mounted on said base and means for selectively moving said drive wheel from a raised position to a lowered position.

* * * * *

UNITED STATES PATENT AND TRADEMARK OFFICE

CERTIFICATE OF CORRECTION

PATENT NO. : 5,380,059

DATED : January 10, 1995

INVENTOR(S) : Gerald J. Felling

It is certified that error appears in the above-indentified patent and that said Letters Patent is hereby corrected as shown below:

In Column 7, Line 65 in Claim 16:
replace "together to form a hood open on frontal side, pivot"
with:

--together to form a hood open on a frontal side, pivot--

Signed and Sealed this

Twenty-fourth Day of October, 1995

*Attest:*

*Attesting Officer*

BRUCE LEHMAN

*Commissioner of Patents and Trademarks*